US007942607B2

(12) United States Patent
Bauder

(10) Patent No.: US 7,942,607 B2
(45) Date of Patent: May 17, 2011

(54) UNDERWATER TUNNEL

(76) Inventor: Edward Marshall Bauder, Ladysmith (CA)

( * ) Notice: Subject to any disclaimer, the term of this patent is extended or adjusted under 35 U.S.C. 154(b) by 0 days.

(21) Appl. No.: 12/528,874

(22) PCT Filed: Sep. 25, 2007

(86) PCT No.: PCT/CA2007/001733

§ 371 (c)(1),
(2), (4) Date: Aug. 27, 2009

(87) PCT Pub. No.: WO2009/039605

PCT Pub. Date: Apr. 2, 2009

(65) Prior Publication Data

US 2010/0092243 A1 Apr. 15, 2010

(51) Int. Cl.
*E02D 29/063* (2006.01)

(52) U.S. Cl. ..... 405/136

(58) Field of Classification Search ..... 405/136
See application file for complete search history.

(56) References Cited

U.S. PATENT DOCUMENTS

| | | | | |
|---|---|---|---|---|
| 131,322 | A * | 9/1872 | Anderson | 405/136 |
| 262,524 | A * | 8/1882 | Williams | 405/136 |
| 447,735 | A * | 3/1891 | Moeser | 405/136 |
| 3,478,521 | A | 11/1969 | Petrik | |
| 3,738,112 | A | 6/1973 | Grant et al. | |
| 3,849,821 | A | 11/1974 | Arild et al. | |
| 4,444,526 | A | 4/1984 | Foundoukos et al. | |
| 5,322,390 | A * | 6/1994 | Niimura | 405/136 |
| 5,899,635 | A | 5/1999 | Kuja et al. | |
| 6,450,734 | B1 | 9/2002 | Kuja et al. | |

FOREIGN PATENT DOCUMENTS

| | | | |
|---|---|---|---|
| DE | 24 23 854 | A1 | 12/1975 |
| FR | 522 112 | A | 7/1921 |
| GB | 2016065 | A * | 9/1979 |
| GB | 2175944 | A * | 12/1986 |
| JP | 04258494 | A * | 9/1992 |
| JP | 7 042182 | A | 2/1995 |
| JP | 7 048849 | A | 2/1995 |
| KR | 2009129001 | A * | 12/2009 |
| WO | W097/43490 | | 11/1997 |

OTHER PUBLICATIONS

International Search Report, pp. 1 to 4.
Written Opinion of the International Searching Authority, pp. 1-4.
Demand for International Preliminary Exam, pp. 1-4, with Article 34 Amendment, pp. 1-10.
International Preliminary Report on Patentability, pp. 1-4, with substitute claim pp. 12-17.

* cited by examiner

*Primary Examiner* — Frederick L Lagman
(74) *Attorney, Agent, or Firm* — Oyen Wiggs Green & Mutala LLP

(57) ABSTRACT

An underwater suspended tunnel (6) has a shaft (10) with generally convex upper and lower outer surfaces (12, 13) meeting at longitudinally extending, transversely streamlined and opposed sides (14, 15). One or more apertures (20*a*, 20*b*) for carrying traffic extend longitudinally through the shaft (10). The shaft (10) has positive net buoyancy and is tethered at a generally uniform depth below sea level (5) by ties (32) anchored to the sea bed (4).

20 Claims, 4 Drawing Sheets

UNDERWATER TUNNEL

TECHNICAL FIELD

This invention relates to an underwater suspended tunnel connecting two land masses separated by a body of water.

BACKGROUND

Bridges are common structures for carrying pedestrian, vehicular, rail traffic and the like over a body of water. If it is neither feasible nor cost effective to construct a bridge, or if an alternate transportation link is desired to alleviate congestion on an existing bridge, an underwater tunnel may be constructed to carry traffic between two land masses separated by a body of water. Underwater tunnels have been constructed by boring a tunnel through the earth beneath the sea bed ("sea" is used herein to refer to any body of water including oceans, lakes and rivers). Underwater tunnels have also been constructed by dredging a trench in the sea bed, lowering preformed tubular sections into the trench, joining the sections together to form one continuous tunnel, backfilling exposed portions of the trench and covering the tunnel with concrete, rock, dirt, mud or other material to hold the tunnel permanently in place on the sea bed. The latter type of tunnel is often referred to as an "immersed tunnel". Some well-known examples of immersed tunnels include:

- the Detroit-Windsor Tunnel spanning the Detroit River and connecting Detroit, Mich., US to Windsor, Ontario, Canada, which opened to traffic in 1930;
- the George Massey Tunnel in the Greater Vancouver region of British Columbia, Canada, spanning the south arm of the Fraser River, which opened to traffic in 1959;
- the Sydney Harbour Tunnel crossing the Sydney Harbour in Sydney, Australia, which opened to traffic in 1992; and
- the Oresund Tunnel, part of the Oresund Tunnel-Bridge connection between Copenhagen, Denmark and Malmö, Sweden, which opened to traffic in 2000.

Immersed tunnels are often not practical to construct when the bed is too rocky, too deep or too undulating. There is a need for an underwater tunnel which is cost effective to build and can overcome at least some of the disadvantages of existing tunnels. There is also a need for an underwater tunnel which has rotational and lateral stability, and resists tidal currents, earthquakes and tsunamis.

BRIEF DESCRIPTION OF DRAWINGS

In drawings which illustrate non-limiting embodiments of the invention.

DESCRIPTION

Throughout the following description, specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
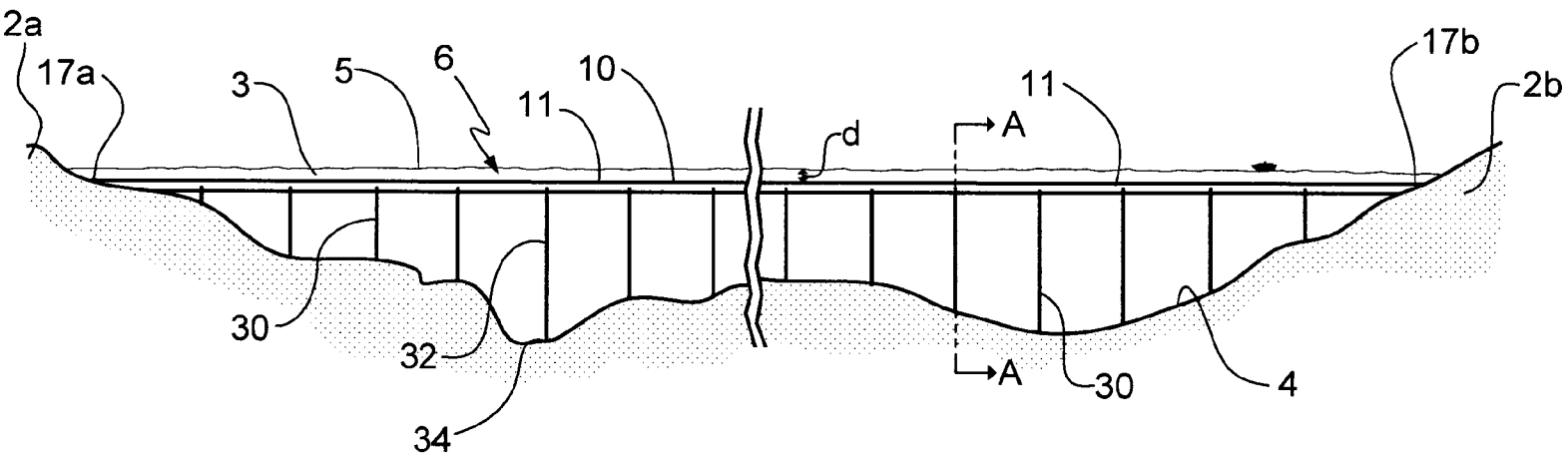
FIG. 1 is a side view of a completed underwater suspended tunnel.

FIG. 1 shows a suspended underwater tunnel 6 extending between two opposing land masses 2*a*, 2*b* separated by a body of water 3 having a bed 4 and a sea level 5 which may vary according to tides. Tunnel 6 has an elongate, positively buoyant shaft 10 which is maintained at a generally uniform depth d below sea level 5 by a series of anchors 30 tethering shaft 10 to bed 4. Anchors 30 include ties 32 coupled between the sides of shaft 10 and anchor blocks 34 on bed 4. Tunnel 6 also has entrances 17*a*, 17*b* at either end connecting to entry/exit tunnels (not shown in FIG. 1) at land masses 2*a*, 2*b* for entry/exit of vehicular or other traffic. Shaft 10 may slope downwardly from entrances 17*a*, 17*b* to reach depth d. The top of shaft 10 is preferably submerged at least 20 meters below low tide level to avoid collision with boats passing over tunnel 6.

As seen in FIG. 1, shaft 10 remains substantially level over undulating sea bed terrain, given that the height of anchors 30 varies along the length of tunnel 6 to accommodate varying levels in bed 4. Since shaft 10 is suspended above bed 4 rather than being immersed in bed 4, shaft 10 may be constructed in deeper water than is generally feasible for immersed tunnels, and shaft 10 may be constructed above many different kinds of sea bed terrain, including rocky sea bed terrain.

Shaft 10 is formed of a plurality of longitudinally interconnected sections 11, which are generally identical to one another in shape and size. The length of each section 11 may be selected taking into account the costs of installing and interconnecting sections 11, the costs of creating a facility to construct sections 11 of the proposed length, etc. Each section 11 may be about 500 meters in length.

Figure 2:
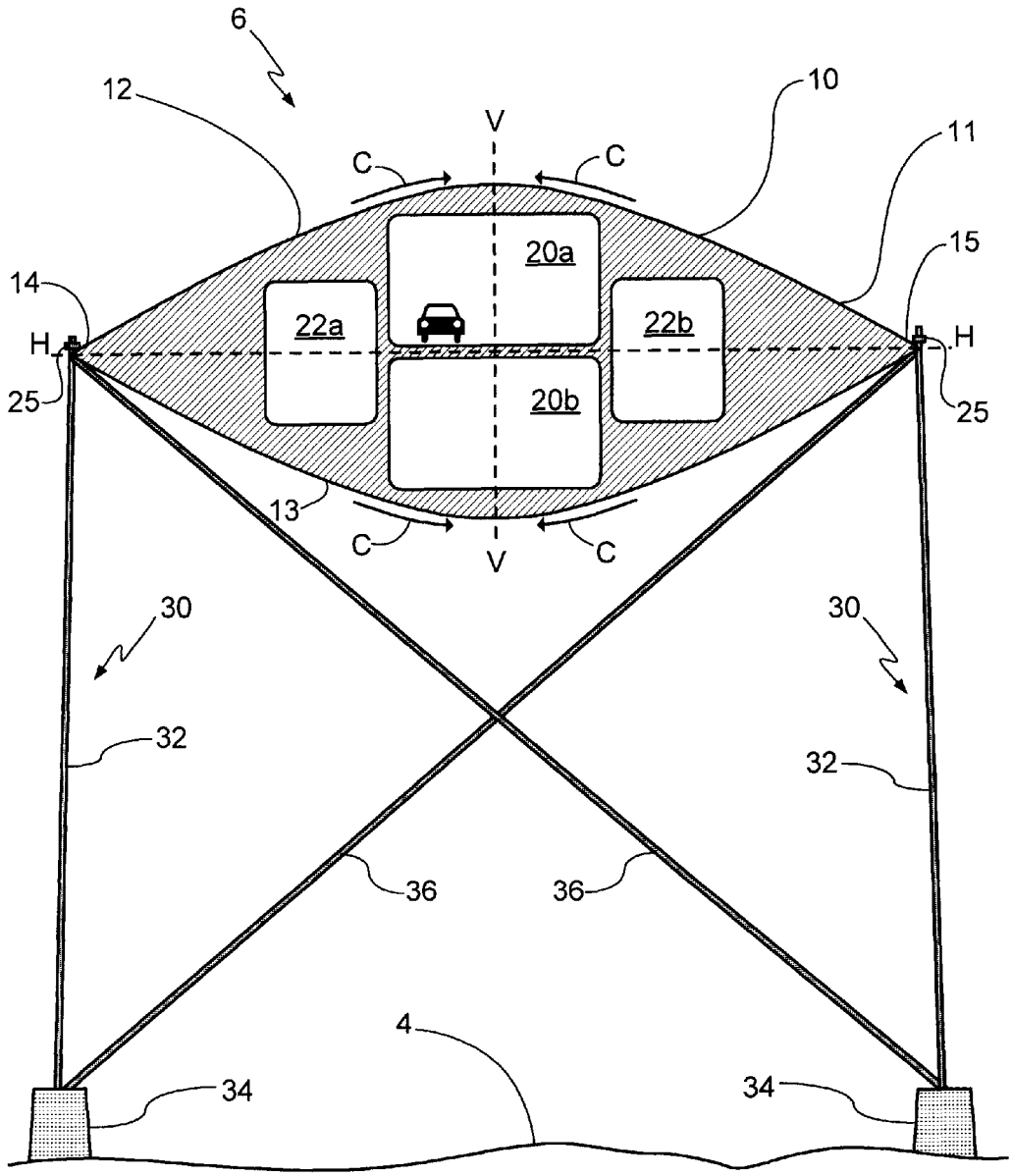
FIG. 2 is a transverse cross-sectional view taken with respect to line A-A in FIG. 1, showing a streamlined shaft embodiment having upper and lower vehicle apertures.

As seen in FIG. 2, shaft 10 (and each section 11) is streamlined in transversely opposed directions. Shaft 10 has generally convex outer upper and lower surfaces 12, 13 meeting along longitudinally-extending, transversely streamlined sides 14, 15. Shaft 10 is formed of material which is strong in compression, such as reinforced, high-density concrete (represented as the cross-hatched portion of shaft 10 in FIG. 2).

Shaft 10 has at least one longitudinally extending aperture for passage of vehicular or other traffic. In the embodiment shown in FIG. 2, upper and lower vehicle apertures 20*a*, 20*b* extend parallel to one another through a central longitudinal portion of shaft 10. Vehicle apertures 20*a*, 20*b* are wide enough to accommodate at least two lanes of traffic each, so that if there is a stall or breakdown in one lane, vehicles may pass in the other lane and emergency vehicles may access the problem vehicle. Each vehicle aperture may be approximately 5 meters high by 8 meters wide (allowing for two lanes of traffic each 4 meters wide).

At least one additional aperture may extend longitudinally through shaft 10 to accommodate extra lanes of traffic or other transportation systems (e.g. light rail or rapid transit). These additional apertures may also be used for ventilation systems, electrical systems, equipment storage, emergency access, maintenance access and the like. FIG. 2 shows first and second lateral apertures 22*a*, 22*b* extending adjacent sides 14, 15 respectively, and alongside vehicle apertures 20*a*, 20*b*. Apertures 22*a*, 22*b* may be each 5 meters high by 4 meters wide. Passageways (not shown) provided at spaced intervals along shaft 10 may extend transversely between apertures 22*a*, 22*b* and central vehicle apertures 20*a*, 20*b* to permit emergency and maintenance crews to access vehicle apertures 20*a*, 20*b*.

Shaft 10 (and each tunnel section 11) is designed to have positive net buoyancy. The buoyancy is sufficient to offset the maximum expected load of traffic and equipment, while maintaining tension in ties 32 for greater stability of tunnel 6. To achieve positive net buoyancy, a sufficient volume of air is contained in the apertures of shaft 10 such that the overall weight of shaft 10, including any load that it is carrying, is less than the weight of the water displaced by shaft 10. The requirement for net buoyancy places design constraints on the amount of concrete used to form shaft 10 and the number and size of the apertures. In the embodiment shown in FIG. 2, the total volume of the apertures is approximately 120 cubic meters per meter of tunnel length, which would require approximately 86 cubic meters of high-density concrete per meter of tunnel length to offset the volume of air in the apertures to achieve neutral buoyancy (assuming that the concrete has a specific density of about 2.4). However, to offset an expected traffic and equipment load of 5 or 6 tonnes per meter of tunnel length, there should be approximately 80 cubic meters of concrete per meter of tunnel length.

The shape of shaft 10 and arrangement of the apertures are also constrained by the need to withstand significant hydrostatic pressure acting on shaft 10. At a depth of 35 meters (the approximate depth of the bottom of aperture 20*b* shown in FIG. 2 if the top of shaft 10 is submerged at 20 meters below sea level 5), the hydrostatic pressure is approximately 35 tonnes per square meter. If aperture 20*b* is 8 meters wide, a force of about 280 tonnes is imposed per meter of tunnel length on the bottom of aperture 20*b*. By contrast, the expected traffic and equipment load is only about 2.5 tonnes per meter of tunnel length, or about 1% of the hydrostatic bending stress.

It is desirable that the hydrostatic pressure is handled by compression stresses in the concrete instead of bending stresses. For example, if tunnel 6 is cylindrical in cross-section, as shown by shaft 10*a* in FIG. 3A, upper and lower vehicle apertures 24*a*, 24*b* may be provided to accommodate two lanes of traffic each. Hydrostatic pressure results in compression stresses acting around the cylindrical surface, with relatively low bending stresses as compared with other tunnel shapes and aperture configurations. However, shaft 10*a* may have a tendency to be somewhat unstable in currents, as the cylindrical shape may lead to turbulence in the waters surrounding shaft 10*a* which would cause shaft 10*a* to oscillate.

Figure 3A:
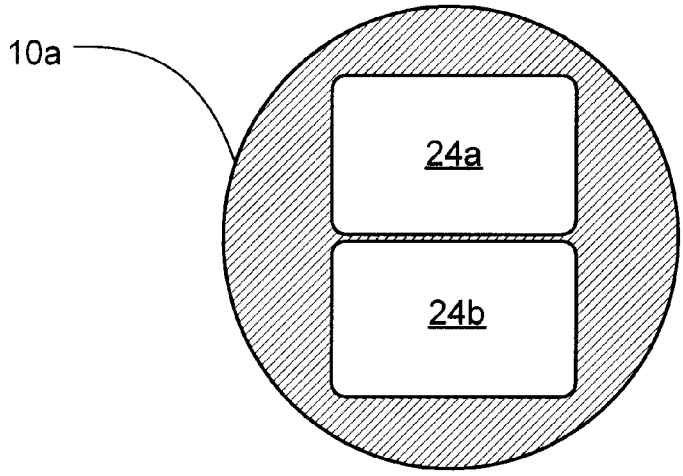
FIG. 3A is a transverse cross-sectional view of a cylindrical shaft embodiment having upper and lower vehicle apertures.
Figure 3B:
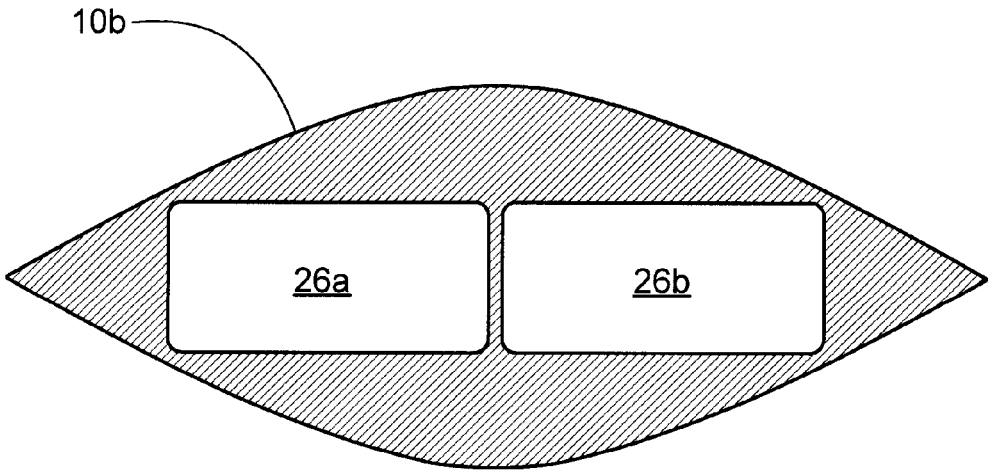
FIG. 3B is a transverse cross-sectional view of a streamlined shaft embodiment having two side-by-side vehicle apertures.

FIG. 3B illustrates a streamlined shaft 10*b* having two vehicle apertures 26*a*, 26*b* arranged side-by-side to accommodate two lanes of traffic each. Shaft 10*b*, which is streamlined in transversely opposed directions, has improved stability in currents in comparison to cylindrical shaft 10*a*. However, with the particular side-by-side aperture configuration shown in FIG. 3B, hydrostatic pressure introduces significant bending stresses across shaft 10*b*. A substantial amount of reinforcement would be required to counteract these bending stresses (e.g. reinforcing bars and concrete especially around the top and bottom of apertures 26*a*, 26*b*). Such reinforcement can be expensive and adds to the weight of shaft 10*b*, making it impractical to achieve positive net buoyancy of shaft 10*b*.

The shape of shaft 10 and arrangement of apertures shown in FIG. 2 have several advantages over the configurations of FIGS. 3A and 3B, including the following advantages:

- Hydrostatic pressure is handled by compression stresses concentrated toward the inflection of arched surfaces 12, 13 as indicated by arrows C in FIG. 2.
- The vertically stacked arrangement of vehicle apertures 20*a*, 20*b* in the embodiment shown in FIG. 2 avoids bending stresses associated with the side-by-side aperture arrangement shown in FIG. 3B.
- Transversely streamlined sides 14, 15 reduce the drag coefficient of shaft 10 (i.e. water may flow more readily around shaft 10, from one side of the shaft to the other) and improve the tunnel's ability to withstand tidal currents and tsunamis.
- The increased distance between a pair of ties 32 attached to sides 14, 15 (as compared with the distance between a pair of ties attached to the sides of circular shaft 10*a*) provides for greater stability under eccentric loads in shaft 10.
- Lateral apertures 22*a*, 22*b* alongside vehicle apertures 20*a*, 20*b* contribute to the positive net buoyancy of shaft 10, and may facilitate other functions (e.g. accommodate extra lanes of traffic, ventilation systems, etc.). At the same time, apertures 22*a*, 22*b* do not materially impact the stress patterns at the corners and across the top and bottom of vehicle apertures 20*a*, 22*b*.

Shaft 10 is symmetrical about a vertical plane V-V (FIG. 2) both with respect to the outside shape of shaft 10 and the interior aperture arrangement. The outside shape of shaft 10 is also symmetrical about a horizontal plane H-H passing through the axis of the shaft. However, the interior arrangement of apertures is not necessarily symmetrical about horizontal plane H-H. For example, the position of vehicle apertures 20*a*, 20*b* may be elevated so that there is more concrete below aperture 20*b* than above aperture 20*a*. Similarly, apertures 22*a*, 22*b* may be elevated. The asymmetrical configuration of the apertures about horizontal plane H-H makes it more difficult for section 11 to be tipped to one side (and likewise, easier for section 11 to achieve an upright position once tipped), for example, during transport of section 11 to the tunnel construction site.

As shown in FIG. 1, shaft 10 is maintained at a generally uniform depth d below sea level 5 by a plurality of anchors 30 which are longitudinally spaced along shaft 10. Pairs of opposing anchors 30 (one on each side 14, 15) are provided along the length of shaft 10 to offset eccentric loads in shaft 10. Each anchor 30 includes a generally vertical tie 32 coupled between an anchor block 34 on bed 4 and one of shaft 10's sides 14, 15. Ties 32 may be rods, a plurality of longitudinally linked rods, cables or chain-links. The length of each tie 32 is variable to maintain shaft 10 at its desired depth below sea level 5 despite variations in the level of bed 4. The height of anchor blocks 34 may also be variable. At certain locations along shaft 10 (e.g. deep water locations) it may be desirable to provide tall anchor blocks 34 to reduce the length of ties 32, thereby making it easier to install and maintain ties 32.

The tension in each tie 32 is advantageously adjustable. A possible mechanism for adjusting the tension in ties 32 is shown in FIG. 2. A pair of ties 32 are inserted through channels in sides 14, 15 respectively, and a nut 25 is screwed to the top end of each tie 32. Tightening of nut 25 increases the tension in tie 32.

Ties 32 are subject to tension which is equal and opposite to the positive net buoyancy of shaft 10. The tension in ties 32 is reduced when shaft 10 is carrying a load from the passage of traffic. In one embodiment, pairs of opposing anchors 30 are spaced apart longitudinally along the shaft by approximately 50 meters. If the positive net buoyancy of shaft 10 without a traffic load is 5 to 6 tonnes per meter of tunnel length, every 50 meter length of the shaft therefore has a maximum net buoyancy of 250 to 300 tonnes, and the upward buoyancy force exerted on each anchor 30 is 125 to 150 tonnes. Each anchor block 34 should have an overall weight on bed 4 which is at least equal to the buoyancy force of 125 to 150 tonnes exerted on each anchor 30 in order to tether shaft 10 at a fixed height above bed 4.

There may also be lateral forces acting on shaft 10 due to tidal currents, tsunamis and the like. These forces are relatively small in comparison to the net buoyancy of 2500 to 3000 tonnes per 500 meter length of shaft 10. For example, it is estimated that a tidal current of 2 knots results in a lateral force of 20 tonnes on each 500 meter-long section, a tidal current of 4 knots results in a lateral force of 80 tonnes per 500 meter-long section, and a tidal current of 8 knots results in a lateral force of 320 tonnes per 500 meter-long section. The lateral forces may be resisted by pairs of crossties 36 extending diagonally between opposing anchors 30 as shown in FIG. 2. Each crosstie 36 is secured to a side 14 or 15 and to an anchor block 34 of an anchor 30 on the opposite side. Crossties 36 are not necessarily attached between every pair of opposing anchors 30. However, at least two pairs of crossties 36 should be provided for each tunnel section 11. Crossties 36 may be rods, a plurality of longitudinally linked rods, cables or chain-links, and the tension in crossties 36 is advantageously adjustable.

Variations in the place of attachment of the lower ends of the crossties are possible. For example, the lower end of each crosstie 36 may be secured to a separate crosstie block on bed 4.

Ties 32 and crossties 36, and any attachment or coupling devices used, may be made of corrosion-resistant materials such as stainless steel, or may be treated with a corrosion-resistant coating. As well, the outer surface of each section 11 may advantageously have a waterproofing and corrosion-resistant coating.

Ventilation systems; electrical systems; lighting; fire suppression systems; remote camera systems; emergency warning systems; and leak detection systems, pumps and piping may be installed in shaft 10.

Adjacent tunnel sections 11 are coupled together by a joint, which includes a tunnel seal. As will be appreciated by a person of skill in the art, tunnel seals are typically made of elastomeric material (such as rubber) and may, for example, include an O-ring and/or interlocking flanges in the gap between two abutting portions of section 11.

Figure 4:
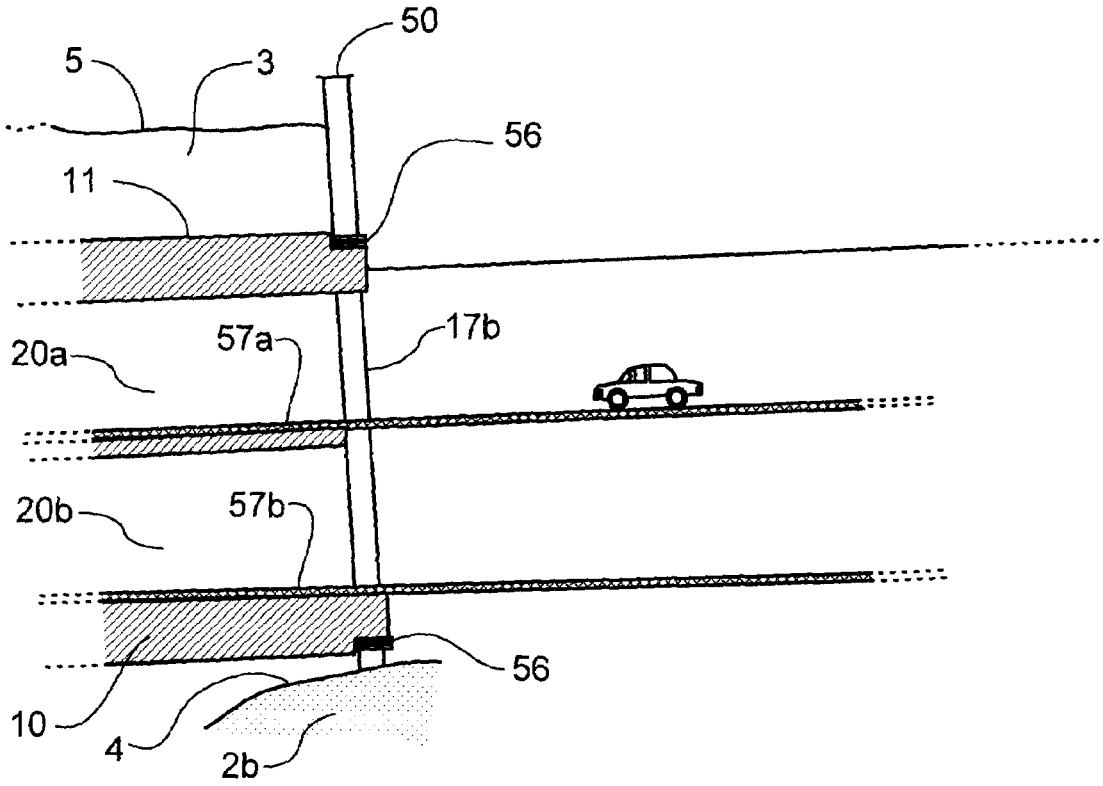
FIG. 4 is a cross-sectional view taken along a vertical plane longitudinally intersecting the axis of the shaft of the underwater suspended tunnel of FIG. 1, showing the shaft joined to a connecting wall at a tunnel entrance.

Longitudinal expansion of shaft 10 may result from varying water temperatures outside the shaft and air temperatures inside the shaft. To reduce movement and stress at the joints between adjacent sections 11 (which can weaken the joints and cause other problems), at least some of the thermal expansion may be accommodated at entrances 17*a*, 17*b*. FIG. 4 shows expansion joints at a land-tunnel interface between shaft 10 and land mass 2*b*. A connecting wall 50 is constructed at the interface with an aperture for receiving shaft 11 and joining it to entranceway 17*b*. Expansion joints 56 are installed at the interface between connecting wall 50 and the outer walls of shaft 10. Expansion joints 56 may be smooth pads (such as Teflon pads) which slide against one other as shaft 10 longitudinally expands and contracts.

As will be appreciated by one of skill in the art, the design and construction of the land-tunnel interface will depend on topography, the formation of the land mass (rock, soil, mud), and other conditions. FIG. 4 illustrates one example of a land-tunnel interface. Various other configurations are possible for the land-tunnel interface, and appropriate tunnel expansion joints may be provided for such configurations.

In preparation for the construction and assembly of tunnel 6, anchor blocks 34 are placed on bed 4. This may be accomplished by tremie pour methods or by other methods known to a person of skill in the art. For example, each anchor block 34 may be precast with a preformed aperture to permit the block to be floated to a site above its proposed location on bed 4. At the site, the aperture may be filled with concrete to sink the block to bed 4.

Each tunnel section 11 may be precast in a floodable dry dock, having its gates closed and all the water pumped out. Removeable bulkheads may be installed toward each end of section 11 so that section 11 will float when the dry dock gates are opened to flood the dry dock. The bulkheads are installed as close to the ends of each section 11 as possible without interfering with the coupling of adjacent sections 11. After each section 11 is made, it may be floated to a temporary storage location until shaft 10 is ready to be constructed.

To construct and assemble shaft 10, each section 11 in turn is floated to its planned installation site. At the site, a pair of floating gantry cranes may be attached to section 11 using winches and cables, so as to provide a platform for positioning and installing section 11. Section 11 is subsequently sunk to the desired depth below sea level 5. This may be accomplished by placing ballast bags (or other containers) in the apertures of section 11 and pumping water into the bags.

Each section 11 is aligned next to a previously installed, adjacent section 11. Sections 11 may have locating pins for aligning and coupling adjacent sections 11 to each other, and for preventing movement in the joints between sections 11. As well, clamping devices may be used to hold adjacent sections 11 together during and after installation.

After section 11 is in position at the desired depth, ties 32 are secured to sides 14, 15 of section 11 and to anchor blocks 34 on bed 4. Crossties 36 may also be attached between pairs of ties 32 as shown in FIG. 2. The tension in ties 32 and crossties 36 may be adjusted to provide generally uniform tension in ties 32 and crossties 36 along the length of shaft 10.

At one or more intervals during installation of section 11, the water in the ballast bags may be pumped out. Eventually all of the water is removed from the bags so that section 11 has positive net buoyancy and is tethered to bed 4 by anchors 30.

Adjacent sections 11 are joined together and sealed. The water is then removed from between the two bulkheads of the adjacent sections, and the seal between the sections is checked for leaks. If there are no leaks, the bulkheads may be removed, and electrical systems, lighting, ventilation fans, leak detection systems, and other systems and equipment may be installed inside section 11.

The steps used to construct tunnel 6 are not necessarily performed in the order described above. Certain steps may be performed simultaneously or divided into sub-tasks performed in combination with other steps. For example, tension in ties 32 and cross-ties 36 may be adjusted preliminarily during installation of each section 11, and fine-tuned after all of sections 11 have been interconnected to form shaft 10.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. An underwater tunnel (6) connecting two land masses (2*a*, 2*b*) separated by a body of water (3), the tunnel (6) comprising:

an elongate shaft (10) having generally convex upper and lower outer surfaces (12, 13) intersecting along longitudinally-extending, transversely opposed first and second sides (14, 15) tapering in opposed directions away from a longitudinal axis of the tunnel (6);

upper and lower vehicle apertures (20*a*, 20*b*) extending longitudinally through a central portion of the shaft (10) for passage of vehicular traffic through either one of the vehicle apertures (20*a*, 20*b*), the upper vehicle aperture (20*a*) extending parallel to and above the lower vehicle aperture (20*b*) and each of the vehicle apertures (20*a*, 20*b*) sized to accommodate at least two lanes of traffic; and a tether (30) coupled between the shaft (10) and a bed (4) of the body of water (3) to maintain the shaft (10) at a generally uniform depth below a surface (5) of the body of water (3);

wherein the shaft (10) comprises a plurality of longitudinally interconnected sections (11), each section (11) integrally formed of reinforced concrete to provide both ballast and structure for the shaft (10), and wherein a combined weight of the shaft (10) and an expected vehicular load in the shaft (10) is equal to or less than a weight of water displaced by the shaft (10).

2. A tunnel as defined in claim 1, further comprising first and second lateral apertures (22*a*, 22*b*) extending longitudinally through the shaft (10) adjacent the first and second sides (14, 15) of the shaft (10).

3. A tunnel as defined in claim 2, wherein the first and second sides (14, 15) of the shaft (10) are streamlined in transversely opposed directions.

4. A tunnel as defined in claim 3, wherein each section (11) is approximately 500 meters in length.

5. A tunnel as defined in claim 3, wherein the tether (30) comprises first and second pluralities of ties (32), the first plurality of ties longitudinally spaced along the first side (14) of the shaft (10), and the second plurality of ties longitudinally spaced along the second side (15) of the shaft (10), each tie (32) having a lower end anchored to the bed (4).

6. A tunnel as defined in claim 5, wherein each first plurality tie is separated from adjacent first plurality ties by approximately 50 meters, and each second plurality tie is separated from adjacent second plurality ties by approximately 50 meters.

7. A tunnel as defined in claim 5, wherein the tether (30) further comprises first and second pluralities of crossties (36), the first plurality of crossties longitudinally spaced along the first side (14) of the shaft (10), the second plurality of crossties longitudinally spaced along the second side (15) of the shaft (10), each first plurality crosstie having a lower end secured to an anchor block (34) of a corresponding one of the second plurality ties, and each second plurality crosstie having a lower end secured to an anchor block (34) of a corresponding one of the first plurality ties.

8. A tunnel as defined in claim 5, wherein the tether (30) further comprises first and second pluralities of crossties (36), the first plurality of crossties longitudinally spaced along the first side (14) of the shaft (10), the second plurality of crossties longitudinally spaced along the second side (15) of the shaft (10), each first plurality crosstie having a lower end anchored to the bed (4) beneath the second side (15) of the shaft (10) and each second plurality crosstie having a lower end anchored to the bed (4) beneath the first side (14) of the shaft (10).

9. A tunnel as defined in claim 7, wherein a lateral force supported by each of the crossties (36) is less than an upward buoyancy force exerted on the first and second pluralities of ties (32).

10. A tunnel as defined in claim 1, wherein each end of the tunnel is coupled to a corresponding tunnel entranceway (17*a*, 17*b*) by at least one expansion joint (56).

11. A tunnel as defined in claim 10, wherein each one of the expansion joints (56) comprises a smooth pad.

12. A tunnel as defined in claim 1, wherein an outside surface of each section has a corrosion-resistant coating.

13. A method for constructing an underwater tunnel (6) connecting two land masses (2*a*, 2*b*) separated by a body of water (3), the method comprising:

sinking a plurality of precast tunnel sections (11) at a tunnel construction site to a generally uniform depth below a surface (5) of the body of water (3), each tunnel section (11) integrally formed of reinforced concrete to provide both ballast and structure to the tunnel section (11), and each tunnel section (11) having:

generally convex upper and lower outer surfaces (12, 13) intersecting along longitudinally-extending, transversely opposed first and second sides (14, 15) tapering in opposed directions away from a longitudinal axis of the tunnel (6), and upper and lower vehicle apertures (20*a*, 20*b*) extending longitudinally through a central portion of the tunnel section (11) for passage of vehicular traffic through either one of the vehicle apertures (20*a*, 20*b*), the upper vehicle aperture (20*a*) extending parallel to and above the lower vehicle aperture (20*b*) and each of the vehicle apertures (20*a*, 20*b*) sized to accommodate at least two lanes of traffic;

tethering each tunnel section (11) to a bed (4) of the body of water (3); and longitudinally coupling together adjacent tunnel sections (11) to form an elongate shaft (10), wherein a combined weight of the shaft (10) and an expected vehicular load in the shaft (10) is equal to or less than a weight of water displaced by the shaft (10).

14. A method as defined in claim 13, wherein the first and second sides (14, 15) of each tunnel section (11) are streamlined in transversely opposed directions.

15. A method as defined in claim 14, wherein sinking the tunnel sections (11) further comprises pumping water into containers within each tunnel section (11).

16. A method as defined in claim 15, further comprising removing the water from the containers in each tunnel section (11) after the tunnel section (11) has been tethered to the bed and coupled to an adjacent tunnel section (11).

17. A method as defined in claim 16, wherein tethering each tunnel section (11) comprises:

coupling a first plurality of ties to the first side (14) of the tunnel section (11) at longitudinally spaced intervals along the tunnel section (11);

coupling a second plurality of ties to the second side (15) of the tunnel section (11) at longitudinally spaced intervals along the tunnel section (11);

anchoring a lower end of each first plurality tie to the bed (4) beneath the first side (14) of the tunnel section (11); and anchoring a lower end of each second plurality tie to the bed (4) beneath the second side (15) of the tunnel section (11).

18. A method as defined in claim 17, wherein tethering each tunnel section (11) further comprises:

coupling a first plurality of crossties to the first side (14) of the tunnel section (11) at longitudinally spaced intervals along the tunnel section (11);

coupling a second plurality of crossties to the second side (15) of the tunnel section (11) at longitudinally spaced intervals along the tunnel section (11);

anchoring a lower end of each first plurality crosstie to the bed (4) beneath the second side (15) of the tunnel section (11); and anchoring a lower end of each second plurality crosstie to the bed (4) beneath the first side (14) of the tunnel section (11).

19. A method as defined in claim 13, wherein the tunnel sections (11) are precast at a dry dock and floated to the tunnel construction site.

20. A method as defined in claim 13, wherein coupling together adjacent tunnel sections (11) comprises fitting a seal between the adjacent tunnel sections (11).

* * * * *